US010655550B2

(12) United States Patent
Whitney et al.

(10) Patent No.: US 10,655,550 B2
(45) Date of Patent: May 19, 2020

(54) INTAKE MANIFOLD AND CYLINDER AIRFLOW ESTIMATION SYSTEMS AND METHODS

(71) Applicant: GM Global Technology Operations LLC, Detroit, MI (US)

(72) Inventors: Christopher E. Whitney, Commerce, MI (US); Layne K. Wiggins, Dexter, MI (US); Rafat F. Hattar, Royal Oak, MI (US); Gary Robert Cygan, Jr., West Bloomfield, MI (US); Ning Jin, Novi, MI (US); Gregory P. Matthews, West Bloomfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 445 days.

(21) Appl. No.: 14/797,374

(22) Filed: Jul. 13, 2015

(65) Prior Publication Data

US 2017/0016407 A1 Jan. 19, 2017

(51) Int. Cl.
*F02D 35/02* (2006.01)
*F02D 37/02* (2006.01)
(Continued)

(52) U.S. Cl.
CPC ..... *F02D 35/024* (2013.01); *F02D 37/02* (2013.01); *F02D 41/182* (2013.01);
(Continued)

(58) Field of Classification Search
CPC ..... F02D 2200/0406; F02D 2200/0408; F02D 2200/0402; F02D 35/024; F02D 37/02;
(Continued)

(56) References Cited

U.S. PATENT DOCUMENTS 4,893,244 A * 1/1990 Tang ..... F02P 5/1504 123/406.65
5,497,329 A * 3/1996 Tang ..... F02D 41/045 123/480

(Continued)

FOREIGN PATENT DOCUMENTS

CN 1432725 A 7/2003
CN 1657755 A 8/2005
EP 2410156 A1 1/2012

OTHER PUBLICATIONS

U.S. Appl. No. 14/617,068, filed Feb. 9, 2015, Whitney et al.
First Office Action for Chinese Application No. 201610480510.2 dated Jan. 23, 2019; 10 pages.

*Primary Examiner* — Mahmoud Gimie
*Assistant Examiner* — Joshua Campbell

(57) ABSTRACT

An engine control system includes a prediction module that, during an exhaust stroke of a first cylinder of an engine, determines a predicted intake manifold pressure at an end of a next intake stroke of a second cylinder following the first cylinder in a firing order of the cylinders. An air per cylinder (APC) module determines a predicted mass of air that will be trapped within the second cylinder at the end of the next intake stroke of the second cylinder based on the predicted intake manifold pressure. A fueling module controls fueling of the second cylinder during the next intake stroke based on the predicted mass of air.

12 Claims, 5 Drawing Sheets

(51) Int. Cl.
*F02D 41/30* (2006.01)
*F02D 41/18* (2006.01)

(52) U.S. Cl.
CPC .. *F02D 41/3005* (2013.01); *F02D 2200/0402* (2013.01); *F02D 2200/0408* (2013.01); *F02D 2200/0411* (2013.01)

(58) Field of Classification Search
CPC ..... F02D 2200/0411; F02D 41/0002; F02D 41/008; F02D 41/18; F02D 41/182; F02D 41/3005; F02D 2009/0228
USPC ..... 123/684
See application file for complete search history.

(56) References Cited

U.S. PATENT DOCUMENTS 6,352,065 B1 * 3/2002 Wild ..... F02D 41/0072 123/494
7,319,929 B1 * 1/2008 Davis ..... F02D 41/18 123/361
2007/0012040 A1 * 1/2007 Nitzke ..... F02D 41/0007 60/605.2
2007/0100534 A1 * 5/2007 Katsumata ..... F02D 35/023 701/103
2007/0113827 A1 * 5/2007 Moriya ..... F02D 13/0203 123/435
2007/0157715 A1 * 7/2007 Boehm ..... F02D 41/0002 73/114.42
2009/0018746 A1 * 1/2009 Miller ..... F02D 35/023 701/102
2011/0010076 A1 * 1/2011 Heinkele ..... F02D 41/187 701/103
2011/0172896 A1 * 7/2011 Oie ..... F02D 41/0002 701/103
2013/0066535 A1 * 3/2013 Leone ..... F02D 41/008 701/103
2014/0069377 A1 * 3/2014 Brennan ..... F02D 41/0002 123/350

* cited by examiner

INTAKE MANIFOLD AND CYLINDER AIRFLOW ESTIMATION SYSTEMS AND METHODS

FIELD

The present disclosure relates to internal combustion engines and more particularly to systems and methods for determining intake manifold pressure and air per cylinder (APC).

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. In some types of engines, air flow into the engine may be regulated via a throttle. The throttle may adjust throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders generally increases the torque output of the engine.

SUMMARY

In a feature, an engine control system is disclosed. A prediction module, during an exhaust stroke of a first cylinder of an engine, determines a predicted intake manifold pressure at an end of a next intake stroke of a second cylinder following the first cylinder in a firing order of the cylinders. An air per cylinder (APC) module determines a predicted mass of air that will be trapped within the second cylinder at the end of the next intake stroke of the second cylinder based on the predicted intake manifold pressure. A fueling module controls fueling of the second cylinder during the next intake stroke based on the predicted mass of air.

In further features, the fueling module controls fueling of the second cylinder during the next intake stroke further based on a target air/fuel mixture.

In further features, the prediction module determines the predicted intake manifold pressure during the exhaust stroke of the first cylinder when a piston of the first cylinder of reaches a predetermined position during the exhaust stroke.

In further features, the prediction module determines the predicted intake manifold pressure based on differences between a mass air flowrate into an intake manifold and a mass air flowrate out of the intake manifold determined during a predetermined period before the piston reaches the predetermined position.

In further features, the prediction module determines the mass air flowrate out of the intake manifold based on a pressure within the intake manifold measured using a manifold pressure sensor and a pressure within the second cylinder.

In further features, the prediction module determines masses of air entering the second cylinder based on mathematical integration of values of the mass air flowrate out of the intake manifold determined during the predetermined period before the piston reached the predetermined position and determines the pressure within the second cylinder based on a mass of air within the second cylinder at an intake valve opening timing of the second cylinder and the masses of air entering the second cylinder.

In further features, the prediction module determines the mass air flowrate into the intake manifold based on a pressure upstream of a throttle valve, an opening of the throttle valve, and a pressure within the intake manifold measured using a manifold pressure sensor.

In further features, a second APC module, during a compression stroke of the second cylinder, determines a mass of air trapped within the second cylinder. A spark control module determines a target spark timing for the second cylinder based on the mass of air trapped within the second cylinder and provides spark to the cylinder based on the target spark timing.

In further features, the second APC module determines the mass of air trapped within the second cylinder during the compression stroke of the second cylinder when a piston of the second cylinder is in a second predetermined position.

In further features, the second APC module determines the mass of air trapped within the second cylinder based on a manifold pressure measured using a manifold pressure sensor when the piston of the second cylinder is in the second predetermined position.

In a feature, an engine control method is described. The engine control method includes: during an exhaust stroke of a first cylinder of an engine, determining a predicted intake manifold pressure at an end of a next intake stroke of a second cylinder following the first cylinder in a firing order of the cylinders; determining a predicted mass of air that will be trapped within the second cylinder at the end of the next intake stroke of the second cylinder based on the predicted intake manifold pressure; and controlling fueling of the second cylinder during the next intake stroke based on the predicted mass of air.

In further features, controlling fueling of the second cylinder during the next intake stroke includes controlling the fueling of the second cylinder during the next intake stroke further based on a target air/fuel mixture.

In further features, determining the predicted intake manifold pressure includes determining the predicted intake manifold pressure during the exhaust stroke of the first cylinder when a piston of the first cylinder of reaches a predetermined position during the exhaust stroke.

In further features, determining the predicted intake manifold pressure includes determining the predicted intake manifold pressure based on differences between a mass air flowrate into an intake manifold and a mass air flowrate out of the intake manifold determined during a predetermined period before the piston reaches the predetermined position.

In further features, the engine control method further includes determining the mass air flowrate out of the intake manifold based on a pressure within the intake manifold measured using a manifold pressure sensor and a pressure within the second cylinder.

In further features, the engine control method further includes: determining masses of air entering the second cylinder based on mathematical integration of values of the mass air flowrate out of the intake manifold determined during the predetermined period before the piston reached the predetermined position; and determining the pressure within the second cylinder based on a mass of air within the second cylinder at an intake valve opening timing of the second cylinder and the masses of air entering the second cylinder.

In further features, the engine control method further includes determining the mass air flowrate into the intake manifold based on a pressure upstream of a throttle valve, an opening of the throttle valve, and a pressure within the intake manifold measured using a manifold pressure sensor.

In further features, the engine control method further includes: during a compression stroke of the second cylinder, determining a mass of air trapped within the second cylinder; determining a target spark timing for the second cylinder based on the mass of air trapped within the second cylinder; and providing spark to the cylinder based on the target spark timing.

In further features, determining the mass of air trapped within the second cylinder during the compression stroke of the second cylinder includes determining the mass of air trapped within the second cylinder during the compression stroke of the second cylinder when a piston of the second cylinder is in a second predetermined position.

In further features, determining the mass of air trapped within the second cylinder during the compression stroke of the second cylinder includes determining the mass of air trapped within the second cylinder based on a manifold pressure measured using a manifold pressure sensor when the piston of the second cylinder is in the second predetermined position.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Internal combustion engines combust an air and fuel mixture within cylinders to generate torque. An engine control module (ECM) controls various engine actuators based on an engine torque request. The engine actuators may include, for example, a throttle valve, fuel injectors, spark plugs, intake and exhaust camshaft phasers, and other engine actuators.

During a compression stroke of a cylinder, the ECM determines a mass of air trapped within the cylinder during the cylinder's intake stroke. The ECM sets a spark timing for the cylinder's next combustion stroke based on the mass of air trapped within the cylinder.

As discussed further below, when a piston of a cylinder reaches a predetermined position during an exhaust stroke of the first cylinder, the ECM determines a predicted intake manifold pressure at an end of a second cylinder's next intake stroke. The second cylinder follows the first cylinder in a firing order of the cylinders. The ECM determines a predicted mass of air that will be trapped within the second cylinder during the next intake stroke based on the predicted intake manifold pressure. The ECM sets fueling for the next intake stroke of the second cylinder based on achieving a target air fuel mixture with the predicted mass of air that will be trapped within the second cylinder during the next intake stroke.

The ECM determines the predicted intake manifold pressure based on differences between mass flowrates of air into and out of the intake manifold during a predetermined period before the piston reaches the predetermined position. The ECM determines the mass flowrate out of the intake manifold (and into a cylinder that is concurrently undergoing its intake stroke) based in part on a pressure within that cylinder. The ECM integrates the mass flowrate of air out of the intake manifold to determine masses of air entering the cylinder. The ECM determines a total mass of air within the cylinder at a given time based on the masses of air that entered the cylinder and a mass of air within the cylinder at its intake valve opening. The ECM updates the pressure within the cylinder based on the total mass of air within the cylinder.

Figure 1:
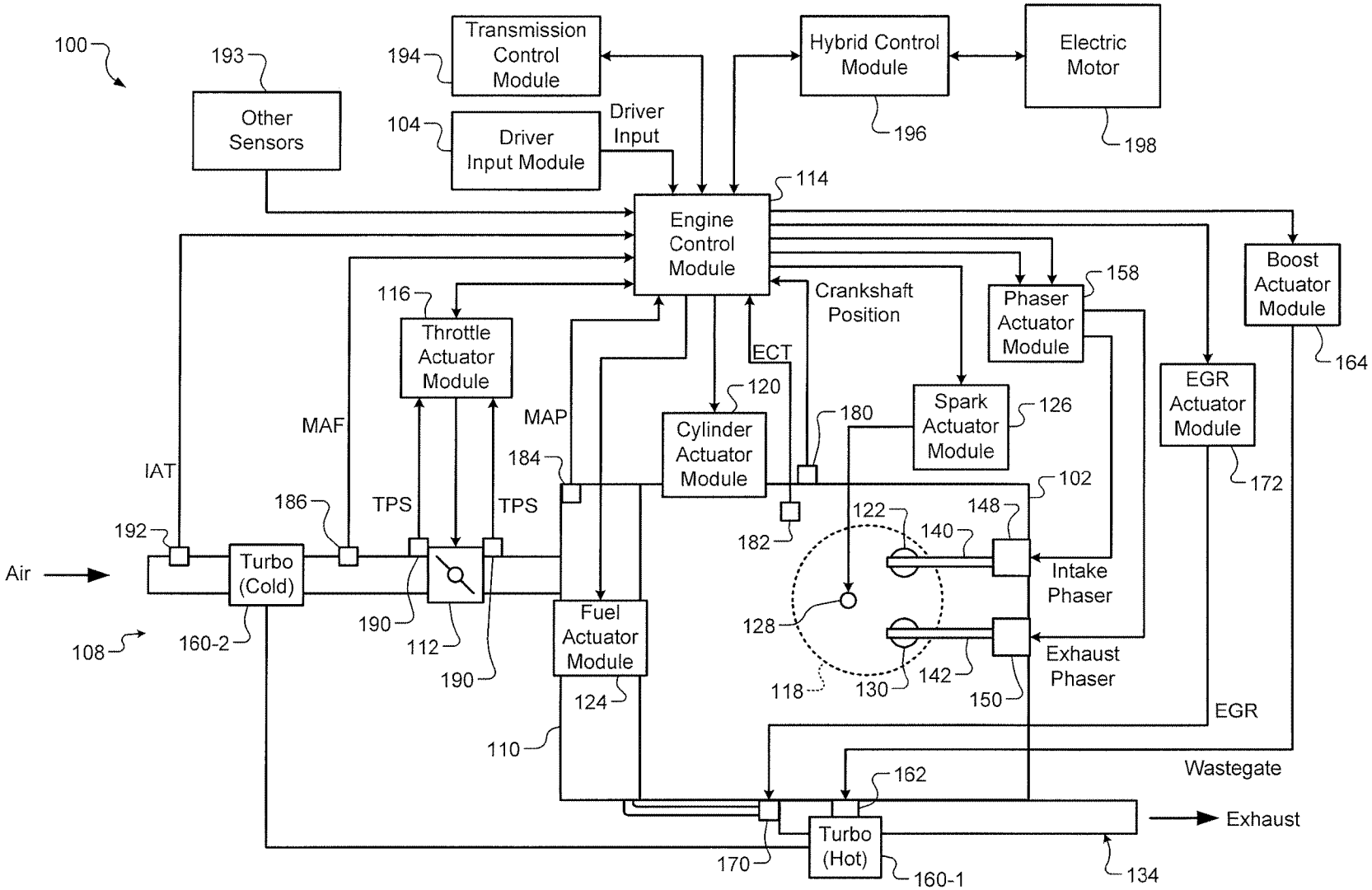
FIG. 1 is a functional block diagram of an example engine system.

Referring now to FIG. 1, a functional block diagram of an example engine system 100 is presented. The engine system 100 of a vehicle includes an engine 102 that combusts an air/fuel mixture to produce torque based on driver input from a driver input module 104. Air is drawn into the engine 102 through an intake system 108. The intake system 108 may include an intake manifold 110 and a throttle valve 112. For example only, the throttle valve 112 may include a butterfly valve having a rotatable blade. An engine control module (ECM) 114 controls a throttle actuator module 116, and the throttle actuator module 116 regulates opening of the throttle valve 112 to control airflow into the intake manifold 110.

Air from the intake manifold 110 is drawn into cylinders of the engine 102. While the engine 102 includes multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders under some circumstances, as discussed further below, which may improve fuel efficiency.

The engine 102 may operate using a four-stroke cycle or another suitable engine cycle. The four strokes of a four-stroke cycle, described below, will be referred to as the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes. For four-stroke engines, one engine cycle may correspond to two crankshaft revolutions.

When the cylinder 118 is activated, air from the intake manifold 110 is drawn into the cylinder 118 through an intake valve 122 during the intake stroke. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers/ports associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a spark-ignition engine, in which case a spark actuator module 126 energizes a spark plug 128 in the cylinder 118 based on a signal from the ECM 114, which ignites the air/fuel mixture. Some types of engines, such as homogenous charge compression ignition (HCCI) engines may perform both compression ignition and spark ignition. The timing of the spark may be specified relative to the time when the piston is at its topmost position, which will be referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with the position of the crankshaft. The spark actuator module 126 may disable provision of spark to deactivated cylinders or provide spark to deactivated cylinders.

During the combustion stroke, the combustion of the air/fuel mixture drives the piston down, thereby driving the crankshaft. The combustion stroke may be defined as the time between the piston reaching TDC and the time when the piston returns to a bottom most position, which will be referred to as bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118). While camshaft based valve actuation is shown and has been discussed, camless valve actuators may be implemented. While separate intake and exhaust camshafts are shown, one camshaft having lobes for both the intake and exhaust valves may be used.

The cylinder actuator module 120 may deactivate the cylinder 118 by disabling opening of the intake valve 122 and/or the exhaust valve 130. The time when the intake valve 122 is opened may be varied with respect to piston TDC by an intake cam phaser 148. The time when the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift (not shown) may also be controlled by the phaser actuator module 158. In various other implementations, the intake valve 122 and/or the exhaust valve 130 may be controlled by actuators other than a camshaft, such as electromechanical actuators, electrohydraulic actuators, electromagnetic actuators, etc.

The engine system 100 may include a boost device that provides pressurized air to the intake manifold 110. For example, FIG. 1 shows a turbocharger including a turbine 160-1 that is driven by exhaust gases flowing through the exhaust system 134. The turbocharger also includes a compressor 160-2 that is driven by the turbine 160-1 and that compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. Although shown separated for purposes of illustration, the turbine 160-1 and the compressor 160-2 may be mechanically linked to each other, placing intake air in close proximity to hot exhaust. The compressed air charge may absorb heat from components of the exhaust system 134.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

Crankshaft position may be measured using a crankshaft position sensor 180. An engine speed may be determined based on the crankshaft position measured using the crankshaft position sensor 180. A temperature of engine coolant may be measured using an engine coolant temperature (ECT) sensor 182. The ECT sensor 182 may be located within the engine 102 or at other locations where the coolant is circulated, such as a radiator (not shown).

A pressure within the intake manifold 110 may be measured using a manifold absolute pressure (MAP) sensor 184. In various implementations, engine vacuum, which is the difference between ambient air pressure and the pressure within the intake manifold 110, may be measured. A mass flow rate of air flowing into the intake manifold 110 may be measured using a mass air flow (MAF) sensor 186. In various implementations, the MAF sensor 186 may be located in a housing that also includes the throttle valve 112.

Position of the throttle valve 112 may be measured using one or more throttle position sensors (TPS) 190. A temperature of air being drawn into the engine 102 may be measured using an intake air temperature (IAT) sensor 192. The engine system 100 may also include one or more other sensors 193. The ECM 114 may use signals from the sensors to make control decisions for the engine system 100.

The ECM 114 may communicate with a transmission control module 194, for example, to coordinate shifting gears in a transmission. For example, the ECM 114 may reduce engine torque during a gear shift. The ECM 114 may communicate with a hybrid control module 196, for example, to coordinate operation of the engine 102 and an electric motor 198. The electric motor 198 may also function as a generator, and may be used to produce electrical energy for use by vehicle electrical systems and/or for storage in a battery. While only the electric motor 198 is shown and discussed, multiple electric motors may be implemented. In various implementations, various functions of the ECM 114, the transmission control module 194, and the hybrid control module 196 may be integrated into one or more modules.

Each system that varies an engine parameter may be referred to as an engine actuator. Each engine actuator has an associated actuator value. For example, the throttle actuator module 116 may be referred to as an engine actuator, and the throttle opening area may be referred to as the actuator value. In the example of FIG. 1, the throttle actuator module 116 achieves the throttle opening area by adjusting an angle of the blade of the throttle valve 112.

The spark actuator module 126 may also be referred to as an engine actuator, while the corresponding actuator value may be the amount of spark advance relative to cylinder TDC. Other engine actuators may include the cylinder actuator module 120, the fuel actuator module 124, the phaser actuator module 158, the boost actuator module 164, and the EGR actuator module 172. For these engine actuators, the actuator values may correspond to a cylinder activation/deactivation sequence, fueling rate, intake and exhaust cam phaser angles, boost pressure, and EGR valve opening area, respectively. The ECM 114 may control the actuator values in order to cause the engine 102 to generate a requested engine output torque.

Figure 2:
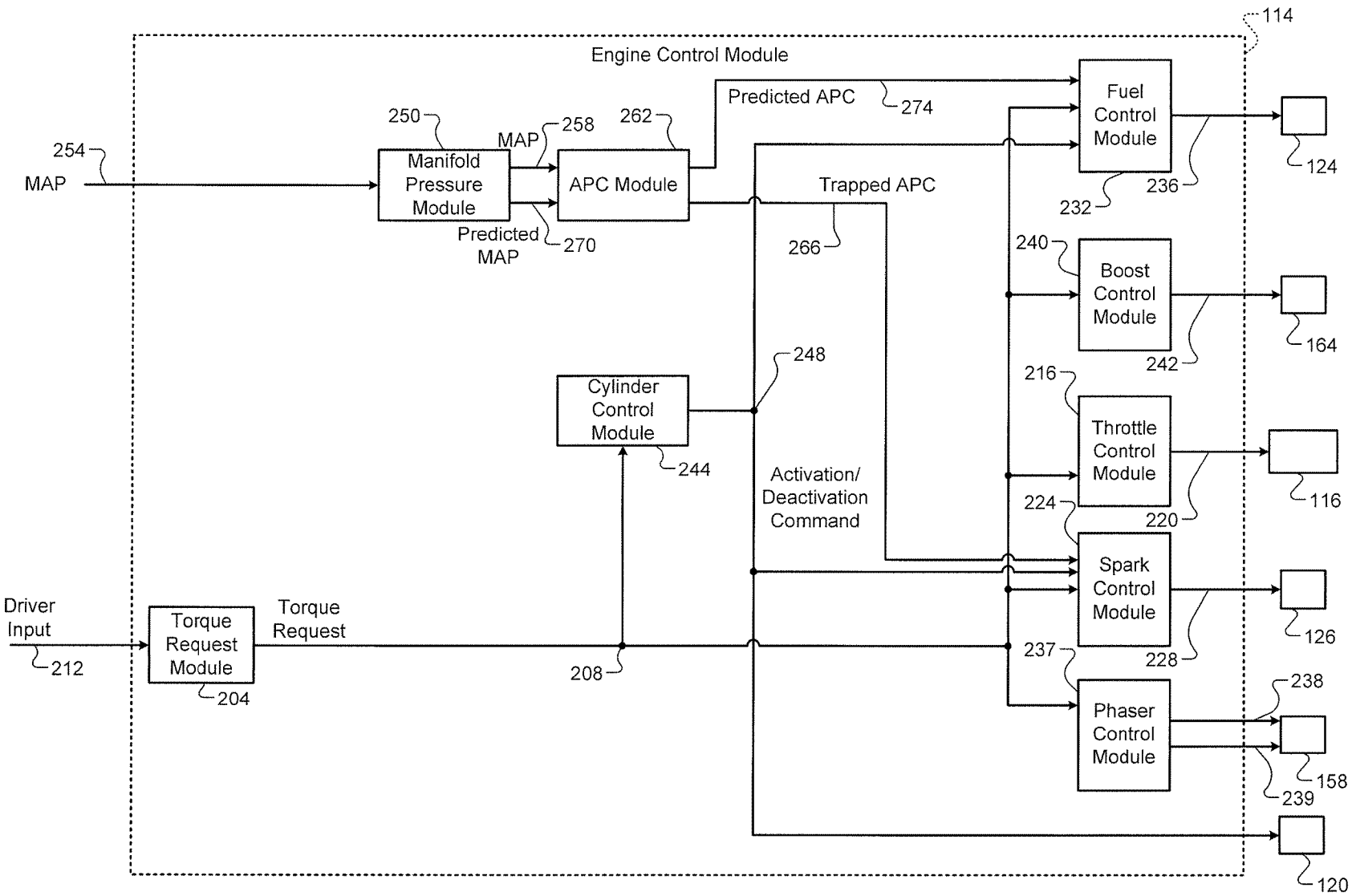
FIG. 2 is a functional block diagram of an example engine control system.

Referring now to FIG. 2, a functional block diagram of an example engine control system is presented. A torque request module 204 determines a torque request 208 for the engine 102 based on one or more driver inputs 212. The driver inputs 212 may include, for example, an accelerator pedal position, a brake pedal position, a cruise control input, and/or one or more other suitable driver inputs. The torque request module 204 may determine the torque request 208 additionally or alternatively based on one or more other torque requests, such as torque requests generated by the ECM 114 and/or torque requests received from other modules of the vehicle, such as the transmission control module 194, the hybrid control module 196, a chassis control module, etc.

One or more engine actuators are controlled based on the torque request 208 and/or one or more other parameters. For example, a throttle control module 216 may determine a target throttle opening 220 based on the torque request 208. The throttle actuator module 116 may adjust opening of the throttle valve 112 based on the target throttle opening 220.

Generally speaking, a spark control module 224 determines a target spark timing 228 based on the torque request 208. The spark actuator module 126 generates spark based on the target spark timing 228. A fuel control module 232 determines one or more target fueling parameters 236. For example, the target fueling parameters 236 may include fuel injection amount, number of fuel injections for injecting the amount, and injection timing. The fuel actuator module 124 injects fuel based on the target fueling parameters 236. Setting of the target spark timing 228 and the target fueling parameters 236 is discussed in more detail below.

A phaser control module 237 determines target intake and exhaust cam phaser angles 238 and 239 based on the torque request 208. The phaser actuator module 158 may regulate the intake and exhaust cam phasers 148 and 150 based on the target intake and exhaust cam phaser angles 238 and 239, respectively. A boost control module 240 may determine a target boost 242 based on the torque request 208. The boost actuator module 164 may control boost output by the boost device(s) based on the target boost 242.

A cylinder control module 244 generates a cylinder activation/deactivation command 248 based on the torque request 208. The cylinder actuator module 120 deactivates the intake and exhaust valves of cylinders that are to be deactivated based on the cylinder activation/deactivation command 248. The cylinder actuator module 120 allows opening and closing of the intake and exhaust valves of cylinders that are to be activated based on the activation/deactivation command 248. The fuel control module 232 halts fueling of cylinders that are to be deactivated.

Cylinder deactivation is different than fuel cutoff (e.g., deceleration fuel cutoff) in that the intake and exhaust valves of cylinders to which fueling is halted during fuel cutoff may still be opened and closed during fuel cutoff whereas the intake and exhaust valves of cylinders are maintained closed when those cylinders are deactivated. The fuel control module 232 halts fueling of one or more cylinders for fuel cutoff.

A manifold pressure module 250 receives a MAP signal 254 generated by the MAP sensor 184. The manifold pressure module 250 samples the MAP signal 254 every predetermined period, such as every 180 crankshaft angle degrees (CAD). The manifold pressure module 250 generates the present MAPs 258 based on the samples of the MAP signal 254, respectively. For example, the manifold pressure module 250 may convert the samples of the MAP signal 254 into the present MAPs 258, respectively.

An air per cylinder module 262 determines a trapped APC 266 during each compression stroke of the engine 102. The trapped APC 266 determined during a cylinder's compression stroke corresponds to a mass of air that is trapped within that cylinder during the cylinder's last intake stroke. The APC module 262 may determine the trapped APC 266 for a cylinder, for example, when the cylinder's piston is in a predetermined position, such as approximately 72 CAD before the piston of that cylinder reaches the TDC position between its compression and combustion strokes.

The spark control module 224 sets the target spark timing 228 for a cylinder based on the trapped APC 266 of that cylinder. The spark actuator module 126 provides spark to the cylinder at the target spark timing 228.

The manifold pressure module 250 also determines a predicted MAP 270 during each exhaust stroke of the engine 102. The predicted MAP 270 determined during the exhaust stroke of one cylinder corresponds to a predicted value of the MAP at the end of the intake stroke of the next cylinder that follows the one cylinder in a predetermined firing order of the cylinders. The manifold pressure module 250 may determine the predicted MAP 270 for a cylinder, for example, when the cylinder's piston is in a second predetermined position, such as approximately 12 CAD before the piston of that cylinder reaches the TDC position between its exhaust stroke and its next intake stroke.

The APC module 262 determines a predicted APC 274 based on the predicted MAP 270 and updates the predicted APC 274 each time that the predicted MAP 270 is updated. The predicted APC 274 determined based on the predicted MAP 270 of the exhaust stroke of one cylinder corresponds to a predicted mass of air that will be trapped within the next cylinder (following the one cylinder in the predetermined firing order) during the next cylinder's next intake stroke.

The fuel control module 232 sets the target fueling parameters 236 for the next cylinder based on the predicted APC 274 for that cylinder. More specifically, the fuel control module 232 determines a target amount of fuel for injection into a cylinder based on a target air/fuel mixture based on the predicted APC 274 for that cylinder. The fuel control module 232 injects fuel for the cylinder based on that cylinder's target fueling parameters 236.

Figure 3:
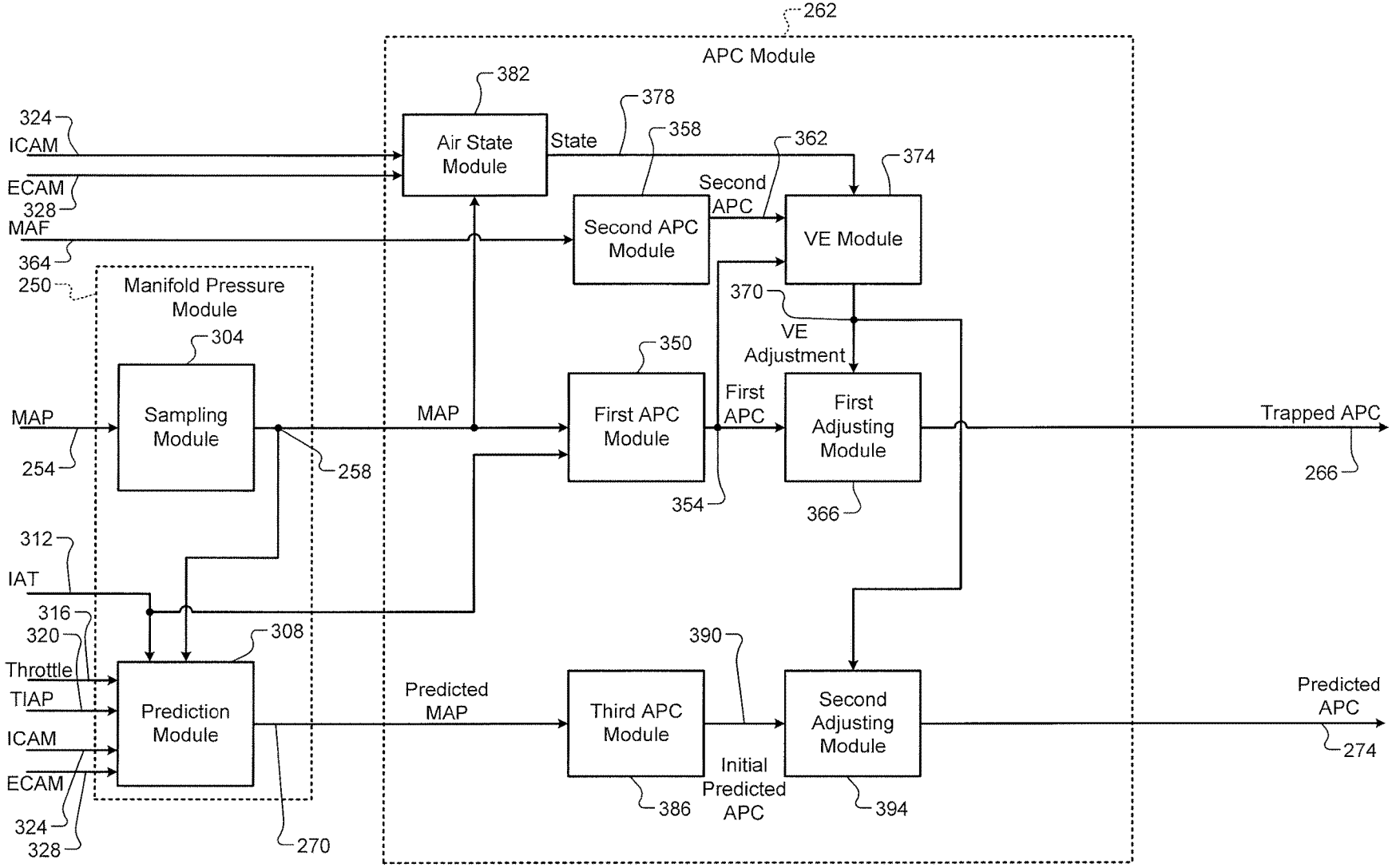
FIG. 3 is a functional block diagram including a manifold pressure module and an air per cylinder (APC) module.

FIG. 3 is a functional block diagram including example implementations of the manifold pressure module 250 and the APC module 262. The manifold pressure module 250 includes a sampling module 304 and a prediction module 308. The sampling module 304 samples the MAP signal 254 generated by the MAP sensor 184 every first predetermined period, such as every 180 CAD or another suitable predetermined period. The sampling module 304 outputs the present MAPs 258 based on the samples of the MAP signal 254. The sampling module 304 may, for example, convert the samples of the MAP signal 254 into the present MAPs 258, respectively. The sampling module 304 generates present MAPs 258 between consecutive samples of the MAP signal 254.

The prediction module 308 determines the predicted MAP 270 during each exhaust stroke. The prediction module 308 may determine the predicted MAP 270 during a cylinder's exhaust stroke when the cylinder's piston is in a first predetermined position. The first predetermined position may be, for example, approximately 12 degrees before the piston of that cylinder reaches the TDC position between exhaust and intake strokes or another suitable position. The period between consecutive instances when the predicted MAP 270 is determined is a second predetermined period, such as 90 or 180 CAD in some types of engines. As stated above, the predicted MAP 270 determined during the exhaust stroke of one cylinder corresponds to a predicted value of the MAP at the end of the intake stroke of the next cylinder to be fueled following the one cylinder in the predetermined firing order of the cylinders.

Figure 4:
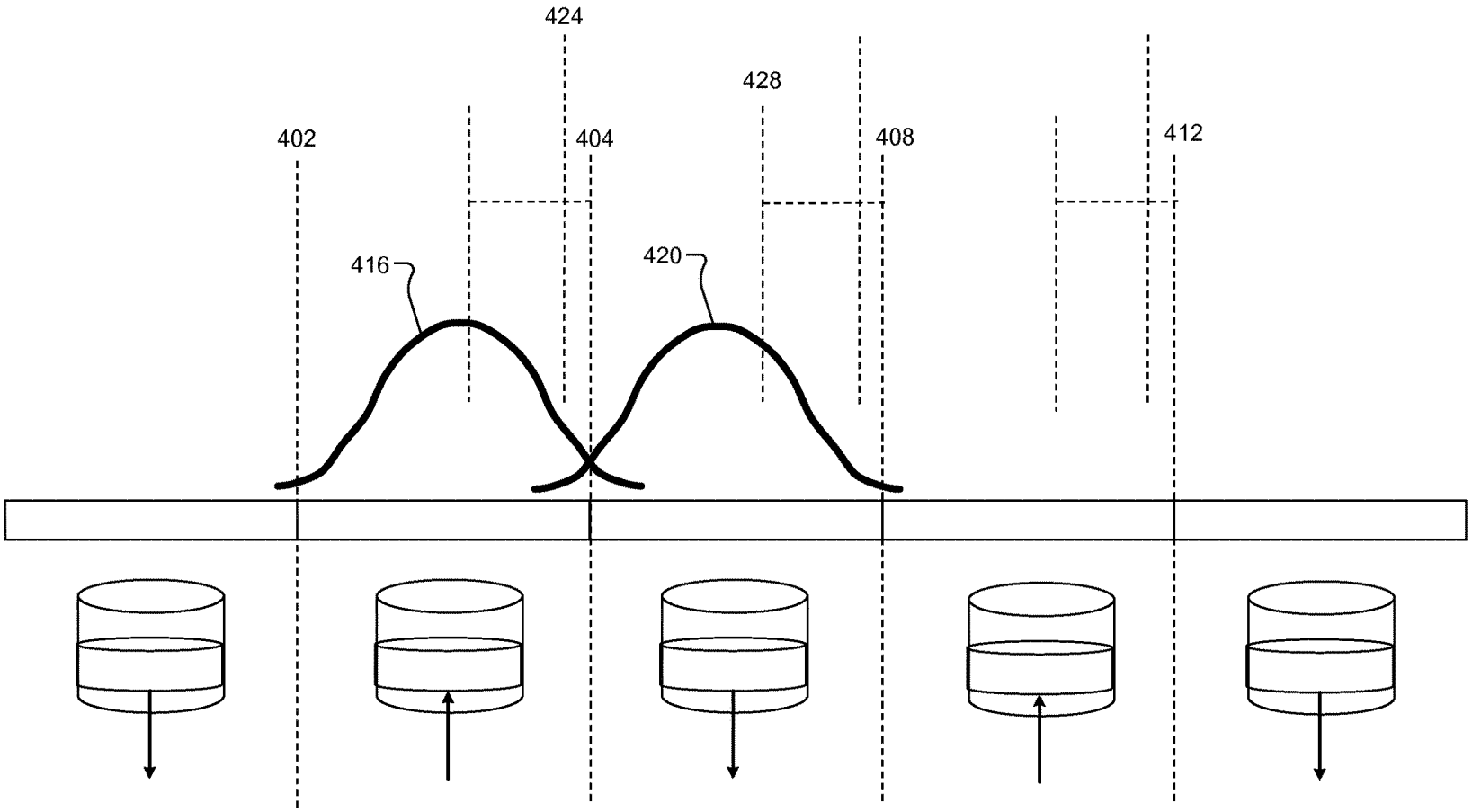
FIG. 4 is a graph illustrating various parameters during an example combustion process.

FIG. 4 includes an example graph of various aspects of a combustion cycle of a cylinder over time. Time 402 corresponds to the end of a combustion stroke of a cylinder and the beginning of an exhaust stroke of the cylinder. Time 404 corresponds to the end of the exhaust stroke of the cylinder and the beginning of an intake stroke of the cylinder. Time 408 corresponds to the end of the intake stroke of the cylinder and a beginning of a compression stroke of the cylinder. Time 412 corresponds to the end of the compression stroke of the cylinder and the beginning of a second combustion stroke of the cylinder. Trace 416 tracks an opening amount of an exhaust valve of the cylinder. Trace 420 tracks an opening amount of an intake valve of the cylinder.

Example time 424 corresponds to approximately when the predicted MAP 270 and the predicted APC 274 may be determined for the cylinder's exhaust stroke for controlling fueling of the next cylinder during that cylinder's intake stroke. Example time 428 corresponds to approximately when the trapped APC 266 may be determined during the cylinder's intake stroke for controlling spark provided to the cylinder during the cylinder's next combustion stroke.

Referring back to FIG. 3, the prediction module 308 determines a mass air flowrate into the intake manifold 110 and a mass air flowrate out of the intake manifold 110 every first predetermined period (e.g., 180 CAD). Determination of the mass air flowrate into the intake manifold 110 and the mass flowrate out of the intake manifold 110 is described in detail below.

The prediction module 308 determines the predicted MAP 270 based on the mass air flowrates into and out of the intake manifold 110 determined since the predicted MAP 270 was last determined, an intake air temperature (IAT) 312, and a volume of the intake manifold 110. More specifically, the prediction module 308 determines mathematical integrals of differences between the mass air flowrate into the intake manifold 110 and the mass air flowrate out of the intake manifold 110 determined since the predicted MAP 270 was last determined. The prediction module 308 sums the values (masses) resulting from the integration to determine an accumulated mass of air. The accumulated mass of air corresponds to a total change in mass of air into or out of the intake manifold 110.

The prediction module 308 determines the predicted MAP 270 when the piston of a cylinder reaches the first predetermined position based on the accumulated mass at the first predetermined position. For example only, the prediction module 308 may determine the predicted MAP 270 based on:

$$PMAP = \frac{RT}{V} * macc,$$

where PMAP is the predicted MAP 270 determined during an exhaust stroke, R is the Ideal Gas Constant, T is the IAT 312, V is a predetermined volume of the intake manifold 110, and macc is the accumulated mass at the first predetermined position. The IAT 312 may be measured, for example, using the intake air temperature sensor 192. While an example function is provided, a mapping may be used in various implementations.

The prediction module 308 determines the mass air flowrate into the intake manifold 110 at a given time based on an opening 316 of the throttle valve 112 at that time, a throttle inlet air pressure (TIAP) 320 at that time, and the present MAP 258 at that time. The prediction module 308 may determine the mass air flowrate into the intake manifold 110 at a given time, for example, using a function or a mapping that relates openings of the throttle valve 112, TIAPs, and MAPs to mass air flowrates into the intake manifold 110. The TIAP 320 may be, for example, measured using a sensor. The TIAP 320 corresponds to a pressure at an inlet of the throttle valve 112. The opening 316 of the throttle valve 112 may be, for example, measured using one or more of the throttle position sensors 190. As used herein, time may be in terms of crankshaft angle.

The prediction module 308 determines the mass air flowrate out of the intake manifold 110 at a given time based on the present MAP 258 at that time, a last pressure within the cylinder that is currently undergoing its intake stroke, and opening of the intake valve(s) of the cylinder at that time. The opening of the intake valve(s) of the cylinder may be represented, for example, by an intake camshaft phaser position (or intake camshaft position) 324. The prediction module 308 may determine the mass air flowrate out of the intake manifold 110, for example, based on a function or a mapping that relates present MAPs, last in-cylinder pressures, and intake camshaft phaser positions to mass air flowrates out of the intake manifold 110. The last pressure within the cylinder that is currently undergoing its intake stroke may refer to the pressure within the cylinder the last time that the pressure within the cylinder was determined. The prediction module 308 may determine the mass air flowrate out of the intake manifold 110 further based on a predetermined coefficient value for airflow through the intake valve(s) of the cylinder.

The prediction module 308 may determine the pressure within the cylinder at a given time based on a mass of air within the cylinder at intake valve opening and masses of air input to the cylinder between intake valve opening and the given time. The mass air flowrate out of the intake manifold 110 at a given time corresponds to a mass flowrate of air into the cylinder at that time that is currently undergoing its intake stroke. As such, the masses of air input to the cylinder may be determined by integrating the values of the mass flowrate out of the intake manifold 110, respectively.

The prediction module 308 may set a mass of air within the cylinder at a given time based on or equal to a sum of the mass of air within the cylinder at intake valve opening and the masses of air input to the cylinder between intake valve opening and that time. The prediction module 308 may determine the mass of air within the cylinder at intake valve opening, for example, based on the intake cam phaser position 324 and an exhaust cam phaser position (or exhaust cam position) 328. The prediction module 308 may determine the mass of air within the cylinder at intake valve opening, for example, using a function or a mapping that relates intake and exhaust cam phaser positions to masses of air in cylinder at intake valve opening.

The prediction module 308 may determine the pressure within the cylinder at a given time based on the mass of air within the cylinder at that time, the IAT 312, and the volume of the cylinder at that time. For example, the prediction module 308 may determine the pressure within the cylinder at a time based on:

$$CylP(ca) = \frac{m(ca)RT}{V(ca)},$$

where CylP(ca) is the pressure within the cylinder at a crankshaft angle (ca), m(ca) is the mass of air within the cylinder at the crankshaft angle, R is the Ideal Gas Constant, T is the IAT 312, and V(ca) is the volume of the cylinder at the crankshaft angle. Cylinder volume varies with piston position. The prediction module 308 may determine the volume of a cylinder at a given time based on crankshaft position. The pressure within the cylinder determined at one time may be used as the last cylinder pressure the first predetermined period later.

A first APC module 350 determines a first APC 354 during each cylinder's compression stroke when the cylinders' pistons, respectively, are in a second predetermined position. The second predetermined position may be, for example, approximately 72 CAD before the piston of that cylinder reaches the TDC position between its compression and combustion strokes or another suitable position. The first APC 354 is used to determine the trapped APC 266, as discussed further below. The first APC 354 of a cylinder's compression stroke corresponds to a mass of air that is trapped within that cylinder during the cylinder's last intake stroke.

The first APC module 350 determines the first APC 354 of a cylinder's compression stroke based on the IAT 312 and the present MAP 258 at the second predetermined position. The first APC module 350 determines the first APC 354 using one or more functions and/or mappings that relate intake air temperatures and MAPs to first APCs. For example, the first APC module 350 may determine the first APC 354 based on the relationship:

$$APC1 = \frac{V * P}{R * T}$$

where APC1 is the first APC 354, V is the predetermined volume of the cylinders, P is the present MAP 258 at the second predetermined position, R is the Ideal Gas Constant, and T is the IAT 312. This relationship may be embodied as an equation or a mapping.

A second APC module 358 determines a second APC 362 for each cylinder based on a MAF 364 measured using the MAF sensor 186. Like the first APC 354, the second APC 362 determined for a cylinder correspond to an amount (e.g., mass) of air that trapped within the cylinder's last intake stroke. The second APC module 358 may determine the second APC 362 when the first APC module 350 determines the first APC 354. The second APC module 358 may also determine the second APC 362 at other times between times when the first APC 354 is determined.

Being based on the MAF 364, the second APC 362 may be more accurate than the first APC 354 under some circumstances, such as during steady-state operation. The second APC module 358 may determine the second APC 362, for example, by mathematically integrating the MAF 364 (e.g., in g/s of air) to determine a mass (e.g., in grams) of air and dividing the resulting mass by the number of activated cylinders of the engine 102.

A first adjusting module 366 determines the trapped APC 266 based on the first APC 354 and a VE adjustment value 370. For example, the first adjusting module 366 may set the trapped APC 266 based on or using the relationship:

$$APC\ T = VEAdj * APC1,$$

where APC T is the trapped APC 266, VEAdj is the VE adjustment value 370, and APC1 is the first APC 354. The spark control module 224 sets the target spark timing 228 for a cylinder based on the trapped APC 266 of that cylinder. The spark actuator module 126 provides spark to the cylinder at the target spark timing 228.

A VE module 374 performs learning to adjust the first APC 354 toward the second APC 362 at times when the second APC 362 may be more accurate than the first APC 354. More specifically, the VE module 374 performs learning when an air state 378 is in a steady-state (SS) state. The VE module 374 disables learning when the air state 378 is in a transient state. The learning is discussed in more detail below.

An air state module 382 sets the air state 378 based on the present MAP 258 the intake cam phaser position 324, and the exhaust cam phaser position 328. For example, the air state module 382 may set the air state 378 to the SS state when the present MAP 258 changes less than a predetermined amount over a predetermined period, the intake cam phaser position 324 changes less than a predetermined amount over a predetermined period, and the exhaust cam phaser position 328 changes less than a predetermined amount over a predetermined period. When one or more of the above change by more than the respective predetermined amounts, the air state module 382 may set the air state 378 to the transient state. While changes in the present MAP 258, the intake cam phaser position 324, and the exhaust cam phaser position 328 are provided as examples, the air state module 382 may set the air state 378 additionally or alternatively based on one or more other parameters.

The VE module 374 performs learning and adjusts the VE adjustment value 370 when the air state 378 is in the SS state. The VE module 374 disables learning/adjustment of the VE adjustment value 370 when the air state 378 is in the transient state. In other words, the VE module 374 maintains the VE adjustment value 370 when the air state 378 is in the transient state.

The VE module 374 learns to adjust the first APC 354 toward the second APC 362. For example, the VE module 374 may determine a difference between the first APC 354 and the second APC 362 and determine the VE adjustment value 370 based on the difference. The VE module 374 may, for example, increase or decrease the VE adjustment value 370 to adjust the first APC 354 toward the second APC 362. In other words, the VE module 374 may incrementally adjust (increase or decrease) the VE adjustment value 370 by up to a predetermined amount each time that the first and second APCs 354 and 362 are determined when the air state 378 is in the SS state.

A third APC module 386 determines an initial predicted APC 390 during each cylinder's compression stroke based on the predicted MAP 270. The initial predicted APC 390 is used to determine the predicted APC 274. Like the predicted APC 274, the initial predicted APC 390 determined based on the predicted MAP 270 of the exhaust stroke of one cylinder corresponds to a predicted mass of air that will be trapped within the next cylinder (following the one cylinder in the predetermined firing order) during the next cylinder's next intake stroke.

The third APC module 386 determines the initial predicted APC 390 of a cylinder's exhaust stroke based on the IAT 312 and the predicted MAP 270 determined when the cylinder's piston is in the first predetermined position. The third APC module 386 determines the initial predicted APC 390 using one or more functions and/or mappings that relate intake air temperatures and predicted MAPs to initial predicted APCs. For example, the third APC module 386 may determine the initial predicted APC 390 based on the relationship:

$$IPAPC = \frac{V * PP}{R * T}$$

where IPAPC is the initial predicted APC 390, V is the predetermined volume of the cylinders, PP is the predicted MAP 270, R is the Ideal Gas Constant, and T is the IAT 312. This relationship may be embodied as an equation or a mapping.

A second adjusting module 394 determines the predicted APC 274 based on the initial predicted APC 390 and the VE adjustment value 370. For example, the second adjusting module 394 may set the predicted APC 274 based on or using the relationship:

$$PAPC = VEAdj * IPAPC,$$

where PAPC is the predicted APC 274, VEAdj is the VE adjustment value 370, and IPAPC is the initial predicted APC 390. As discussed above, the fuel control module 232 sets the target fueling parameters 236 for the next cylinder based on the predicted APC 274 for that cylinder. The fuel actuator module 124 fuels the next cylinder during its next intake stroke based on the target fueling parameters 236.

Figure 5:
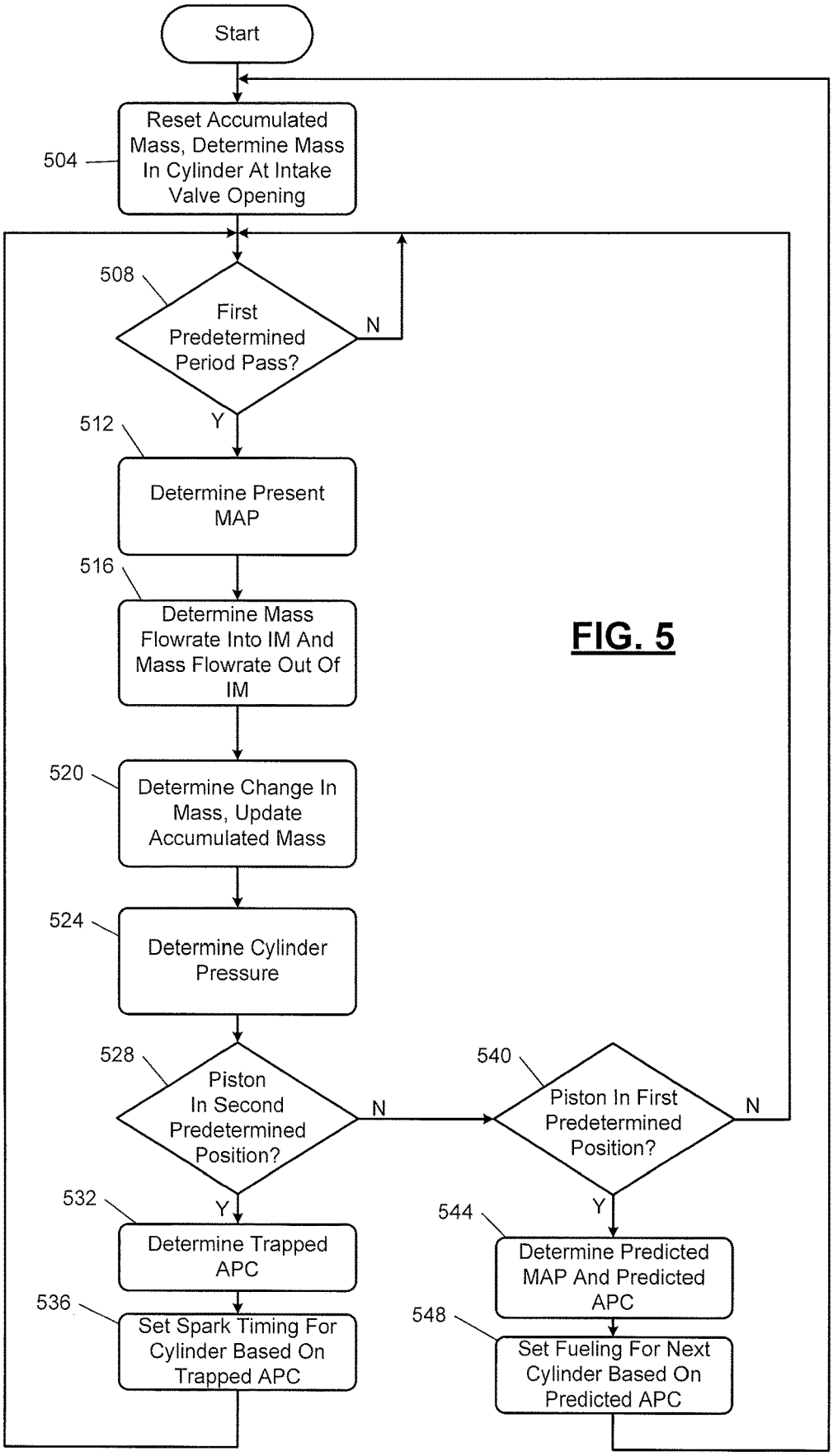
FIG. 5 includes a flowchart depicting an example method of determining a predicted manifold pressure, a predicted mass of APC, and a mass of air trapped within a cylinder.

FIG. 5 is a flowchart depicting an example method of determining the trapped APC 266, the predicted MAP 270, the predicted APC 274, and controlling fueling and spark. Control begins with 504 where the prediction module 308 resets the accumulated mass and determines the mass of air within a cylinder at intake valve opening. The prediction module 308 may determine the mass of air within the cylinder at intake valve opening, for example, based on the intake and exhaust cam phaser positons 324 and 328. The prediction module 308 sets the accumulated mass equal to the mass of air at intake valve opening at 504.

At 508, the sampling module 304 determines whether the first predetermined period has passed since the present MAP 258 was last determined. For example, the sampling module 304 may determine whether the crankshaft has rotated by a first predetermined amount, such as approximately 180 CAD at 508. If 508 is true, control continues with 512. If 508 is false, control may remain at 508.

At 512, the sampling module 304 samples the MAP signal 254 from the MAP sensor 184 and determines the present MAP 258 based on the sample. At 516, the prediction module 308 determines the mass air flowrates into and out of the intake manifold 110, as described above. At 520, the prediction module 308 determines a mathematical integral of the mass flow rate out of the intake manifold 110 from 516. The result of the integral is a mass of air that entered the cylinder. The prediction module 308 sums this mass with the accumulated mass to update the accumulated mass of air within the cylinder.

At 524, the prediction module 308 determines the pressure within the cylinder based on the accumulated mass of air within the cylinder, as discussed above. The pressure within the cylinder determined at 524 will be used to determine the mass air flowrate out of the intake manifold 110 when 516 is next performed, as discussed above.

At 528, the first APC module 350 determines whether the cylinder's piston is in the second predetermined position. For example, the first APC module 350 may determine whether the piston of the cylinder is approximately 72 degrees before the piston reaches the TDC position between the cylinder's compression and combustion strokes. If 528 is false, control transfers to 540, which is discussed further below. If 528 is true, at 532 the first APC module 350 determines the first APC 354 based on the present MAP 258 determined at 512, as discussed above. The first adjusting module 366 adjusts the first APC 354 based on the VE adjustment value 370 to produce the trapped APC 266.

The spark control module 224 sets the target spark timing 228 for the combustion stroke of the cylinder based on the trapped APC 266 and the torque request 208 at 536. The spark control module 224 may determine the target spark timing 228 further based on one or more other parameters. For example, the spark control module 224 may determine the target spark timing 228 using a function or a mapping that relates torque requests, trapped APCs, and the one or more other parameters to target spark timing. For example, for a given torque request (Tt) 208, the target spark timing (St) may be determined based on $$S_t = f^{-1}(T_t, APC, I, E, AF, OT, \#), \quad (2)$$

where APC is trapped APC, I is intake cam phaser position, E is exhaust cam phaser position, AF is target air/fuel ratio, OT is oil temperature, and # is the number of activated cylinders. Additional variables may also be accounted for, such as the degree of opening of an exhaust gas recirculation (EGR) valve. The spark actuator module 126 provides spark to the cylinder based on the target spark timing 228, and control returns to 508.

At 540, the prediction module 308 determines whether the cylinder's piston is in the first predetermined position. For example, the prediction module 308 may determine whether the piston of the cylinder is approximately 12 degrees before the TDC position between the cylinder's exhaust and intake strokes. If 540 is false, control returns to 508. If 540 is true, at 544 the prediction module 308 determines the predicted MAP 270, as discussed above. Also at 544, the third APC module 386 determines the initial predicted APC 390 for the next cylinder in the predetermined firing order of the cylinders based on the predicted MAP 270, as also discussed above. The second adjusting module 394 adjusts the initial predicted APC 390 based on the VE adjustment value 370 to produce the predicted APC 274.

At 548, the fuel control module 232 sets the target fueling parameters 236 for the next cylinder based on the predicted APC 274. For example, the fuel control module 232 may set a target fuel injection amount for the next cylinder based on achieving a target air/fuel mixture given the predicted APC 274. The fuel actuator module 124 injects fuel into the next cylinder during the next cylinder's intake stroke based on the target fueling parameters 236, and control returns to 504.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. An engine control system comprising:

a prediction module that, during an exhaust stroke of a first cylinder of an engine, determines a predicted intake manifold pressure at an end of a next intake stroke of a second cylinder following the first cylinder in a firing order of the cylinders, wherein the prediction module determines the predicted intake manifold pressure during the exhaust stroke of the first cylinder when a piston of the first cylinder reaches a predetermined position during the exhaust stroke, and wherein the prediction module determines the predicted intake manifold pressure based on differences between first values of a mass air flowrate into an intake manifold and second values of a mass air flowrate out of the intake manifold determined during a predetermined period before the piston reaches the predetermined position, wherein the prediction module determines the second values of the mass air flowrate out of the intake manifold based on a pressure within the intake manifold measured using a manifold pressure sensor and a pressure within the second cylinder, wherein the prediction module determines masses of air entering the second cylinder based on mathematical integration of the second values of the mass air flowrate out of the intake manifold determined during the predetermined period before the piston reached the predetermined position and determines the pressure within the second cylinder based on a mass of air within the second cylinder at an intake valve opening timing of the second cylinder and the masses of air entering the second cylinder, and wherein the prediction module determines the mass of air within the second cylinder at the intake valve opening timing of the second cylinder based on an intake cam position and an exhaust cam position;

an air per cylinder (APC) module that, when the piston of the first cylinder reaches the predetermined position during the exhaust stroke of the first cylinder, determines a predicted mass of air that will be trapped within the second cylinder at the end of the next intake stroke of the second cylinder based on the predicted intake manifold pressure; and a fueling module that controls fueling of the second cylinder during the next intake stroke based on the predicted mass of air.

2. The engine control system of claim 1 wherein the fueling module controls fueling of the second cylinder during the next intake stroke further based on a target air/fuel mixture.

3. The engine control system of claim 1 wherein the prediction module determines the first values of the mass air flowrate into the intake manifold based on a pressure upstream of a throttle valve, an opening of the throttle valve, and a pressure within the intake manifold measured using a manifold pressure sensor.

4. The engine control system of claim 1 further comprising:

a second APC module that, during a compression stroke of the second cylinder, determines a mass of air trapped within the second cylinder; and a spark control module that determines a target spark timing for the second cylinder based on the mass of air trapped within the second cylinder and that provides spark to the second cylinder based on the target spark timing.

5. The engine control system of claim 4 wherein the second APC module determines the mass of air trapped within the second cylinder during the compression stroke of the second cylinder when a piston of the second cylinder is in a second predetermined position.

6. The engine control system of claim 5 wherein the second APC module determines the mass of air trapped within the second cylinder based on a manifold pressure measured using a manifold pressure sensor when the piston of the second cylinder is in the second predetermined position.

7. An engine control method comprising:

during an exhaust stroke of a first cylinder of an engine, determining a predicted intake manifold pressure at an end of a next intake stroke of a second cylinder following the first cylinder in a firing order of the cylinders, wherein determining the predicted intake manifold pressure includes determining the predicted intake manifold pressure during the exhaust stroke of the first cylinder when a piston of the first cylinder reaches a predetermined position during the exhaust stroke, and wherein determining the predicted intake manifold pressure includes determining the predicted intake manifold pressure based on differences between first values of a mass air flowrate into an intake manifold and second values of a mass air flowrate out of the intake manifold determined during a predetermined period before the piston reaches the predetermined position;

determining the second values of the mass air flowrate out of the intake manifold based on a pressure within the intake manifold measured using a manifold pressure sensor and a pressure within the second cylinder;

determining masses of air entering the second cylinder based on mathematical integration of the second values of the mass air flowrate out of the intake manifold determined during the predetermined period before the piston reached the predetermined position;

determining the pressure within the second cylinder based on a mass of air within the second cylinder at an intake valve opening timing of the second cylinder and the masses of air entering the second cylinder;

determining the mass of air within the second cylinder at the intake valve opening timing of the second cylinder based on an intake cam position and an exhaust cam position;

when the piston of the first cylinder reaches the predetermined position during the exhaust stroke of the first cylinder, determining a predicted mass of air that will be trapped within the second cylinder at the end of the next intake stroke of the second cylinder based on the predicted intake manifold pressure; and controlling fueling of the second cylinder during the next intake stroke based on the predicted mass of air.

8. The engine control method of claim 7 wherein controlling fueling of the second cylinder during the next intake stroke includes controlling the fueling of the second cylinder during the next intake stroke further based on a target air/fuel mixture.

9. The engine control method of claim 7 further comprising determining the first values of the mass air flowrate into the intake manifold based on a pressure upstream of a throttle valve, an opening of the throttle valve, and a pressure within the intake manifold measured using a manifold pressure sensor.

10. The engine control method of claim 7 further comprising:

during a compression stroke of the second cylinder, determining a mass of air trapped within the second cylinder;

determining a target spark timing for the second cylinder based on the mass of air trapped within the second cylinder; and providing spark to the second cylinder based on the target spark timing.

11. The engine control method of claim 10 wherein determining the mass of air trapped within the second cylinder during the compression stroke of the second cylinder includes determining the mass of air trapped within the second cylinder during the compression stroke of the second cylinder when a piston of the second cylinder is in a second predetermined position.

12. The engine control method of claim 11 wherein determining the mass of air trapped within the second cylinder during the compression stroke of the second cylinder includes determining the mass of air trapped within the second cylinder based on a manifold pressure measured using a manifold pressure sensor when the piston of the second cylinder is in the second predetermined position.

* * * * *